US008454043B2

(12) United States Patent
Uto et al.

(10) Patent No.: US 8,454,043 B2
(45) Date of Patent: Jun. 4, 2013

(54) DRESSING COVER STRUCTURE IN CONSTRUCTION MACHINE

(75) Inventors: Ryoji Uto, Akashi (JP); Ryota Oga, Takasago (JP); Shintaro Nishiyama, Kakogawa (JP); Kouichi Mitsukawa, Kobe (JP)

(73) Assignee: Caterpillar SARL, Geneva (CH)

( * ) Notice: Subject to any disclaimer, the term of this patent is extended or adjusted under 35 U.S.C. 154(b) by 213 days.

(21) Appl. No.: 12/867,157

(22) PCT Filed: Dec. 16, 2008

(86) PCT No.: PCT/JP2008/003785

§ 371 (c)(1),
(2), (4) Date: Aug. 11, 2010

(87) PCT Pub. No.: WO2009/107181

PCT Pub. Date: Sep. 3, 2009

(65) Prior Publication Data

US 2011/0018308 A1 Jan. 27, 2011

(30) Foreign Application Priority Data

Feb. 27, 2008 (JP) ..... 2008-045716

(51) Int. Cl.
*B60R 3/04* (2006.01)

(52) U.S. Cl.
USPC ..... 280/169; 280/163

(58) Field of Classification Search
USPC ..... 280/163, 169
See application file for complete search history.

(56) References Cited

U.S. PATENT DOCUMENTS

| | | | | |
|---|---|---|---|---|
| 4,203,611 | A * | 5/1980 | Makela | 280/163 |
| 6,913,286 | B2 * | 7/2005 | Kramer | 280/762 |
| 7,832,519 | B2 * | 11/2010 | Sakamoto et al. | 180/312 |

FOREIGN PATENT DOCUMENTS

| | | |
|---|---|---|
| JP | A-10-292429 | 11/1998 |
| JP | A-2001-262620 | 9/2001 |
| JP | A-2002-256593 | 9/2002 |
| JP | A-2005-248618 | 9/2005 |

OTHER PUBLICATIONS

Written Opinion mailed Apr. 7, 2009 in International Application No. PCT/JP2008/003785 (with translation).
International Search Report mailed Apr. 7, 2009 in International Application No. PCT/JP2008/003785 (with translation).

* cited by examiner

*Primary Examiner* — J. Allen Shriver, II
*Assistant Examiner* — Erez Gurari
(74) *Attorney, Agent, or Firm* — Oliff & Berridge, PLC

(57) ABSTRACT

A construction machine includes a tank with an upper surface and a side surface that is configured to allow a user to get onto and off the upper surface; and a dressing cover that covers part of the side surface, an upper portion of the dressing cover being formed by an inclined surface having an inclination angle set so as not to allow the user who gets onto and off the upper surface to step on the upper portion.

9 Claims, 6 Drawing Sheets

DRESSING COVER STRUCTURE IN CONSTRUCTION MACHINE

CROSS-REFERENCE TO RELATED APPLICATIONS

This application is the U.S. National Phase of PCT/JP2008/003785, filed Dec. 16, 2008, which claims priority from Japanese Patent Application No. 2008-045716 filed Feb. 27, 2008, the entire disclosure of which is incorporated herein by reference hereto.

BACKGROUND

The present disclosure relates to a dressing cover structure to be provided for covering a tank side surface in a construction machine.

Generally, some construction machines, such as hydraulic shovels, are configured so that a worker is allowed to get onto and off an upper surface of a tank (fuel tank or hydraulic oil tank) equipped on the construction machine. The worker can use the tank upper surface as a scaffold or walkway when performing maintenance and refueling, etc. Some construction machines have a tank side surface on a side where the worker passes to get onto and off the tank upper surface, which is covered by a dressing cover (for example, refer to Japanese Published Unexamined Patent Application No. 2001-262620 and Japanese Published Unexamined Patent Application No. 2005-248618).

SUMMARY

The dressing covers of Japanese Published Unexamined Patent Application No. 2001-262620 and Japanese Published Unexamined Patent Application No. 2005-248618 have upper surfaces formed so as to be substantially flush with the tank upper surface. The upper surface of the dressing cover is what the worker normally steps on when the worker goes up and down between the tank upper surface and a scaffold on the lower side. Therefore, the dressing cover must be sufficiently strong so that the cover does not deform and come off when it is stepped on by a worker, which increases costs.

When the tank upper surface is used as a scaffold or walkway, as shown in Japanese Published Unexamined Patent Application No. 2001-262620, an upper surface plate with an antiskid function is generally attached to the tank upper surface. However, as described above, the upper surface of the dressing cover is what the worker normally steps on. As a result, the upper surface of the dressing cover is also required to have an antiskid function, therefore further increasing costs.

A first aspect of the present disclosure provides a construction machine that includes a tank with an upper surface and a side surface that is configured to allow a user to get onto and off the upper surface; and a dressing cover that covers part of the side surface, an upper portion of the dressing cover being formed by an inclined surface having an inclination angle set so as not to allow the user who gets onto and off the upper surface to step on the upper portion.

A second aspect of the present disclosure provides the construction machine, wherein the upper portion of the dressing cover has a first part and a second part, and the inclined surface of the dressing cover is formed across only the first part of the upper portion.

A third aspect of the present disclosure provides the construction machine, wherein an upper end of the inclined surface of the dressing cover is lower than the upper surface of the tank.

A fourth aspect of the present disclosure provides the construction machine, wherein: an upper surface plate with an antiskid portion is attached to the upper surface of the tank, a dressing cover side edge portion of the upper surface plate is bent downward and hung down from the upper surface of the tank, and the side surface of the tank between the upper end of the inclined surface of the dressing cover and the upper surface of the tank is covered by the dressing cover side edge portion.

According to the first aspect of the present disclosure, stepping on the upper portion of the dressing cover by a worker who gets onto and off the tank upper surface can be reliably avoided. Therefore, it becomes unnecessary to structure the dressing cover with a sufficient strength and attachment in order to withstand the stepping on by a worker. The dressing cover can thus be made light in weight and inexpensive, and does not need to have an antiskid function, which greatly contributes to cost reduction.

According to the second aspect of the present disclosure, stepping on the dressing cover by a worker can be prevented across the entire upper portion of the dressing cover.

According to the third aspect of the present disclosure, the risk of stepping on the upper end of the inclined surface by a worker's foot put on the tank upper surface can be reliably prevented.

According to the fourth aspect of the present disclosure, by the hung-down portion of the upper surface plate, the tank side surface between the upper end of the inclined surface of the dressing cover and the tank upper surface is covered. Therefore, although the upper end position of the inclined surface is set lower than the tank upper surface, the upper portion of the tank side surface is not exposed, and therefore an excellent external appearance can be obtained.

BRIEF DESCRIPTION OF THE DRAWINGS

Various embodiments of the disclosure will be described with reference to the drawings, wherein.

DETAILED DESCRIPTION OF EMBODIMENTS

Figure 1:
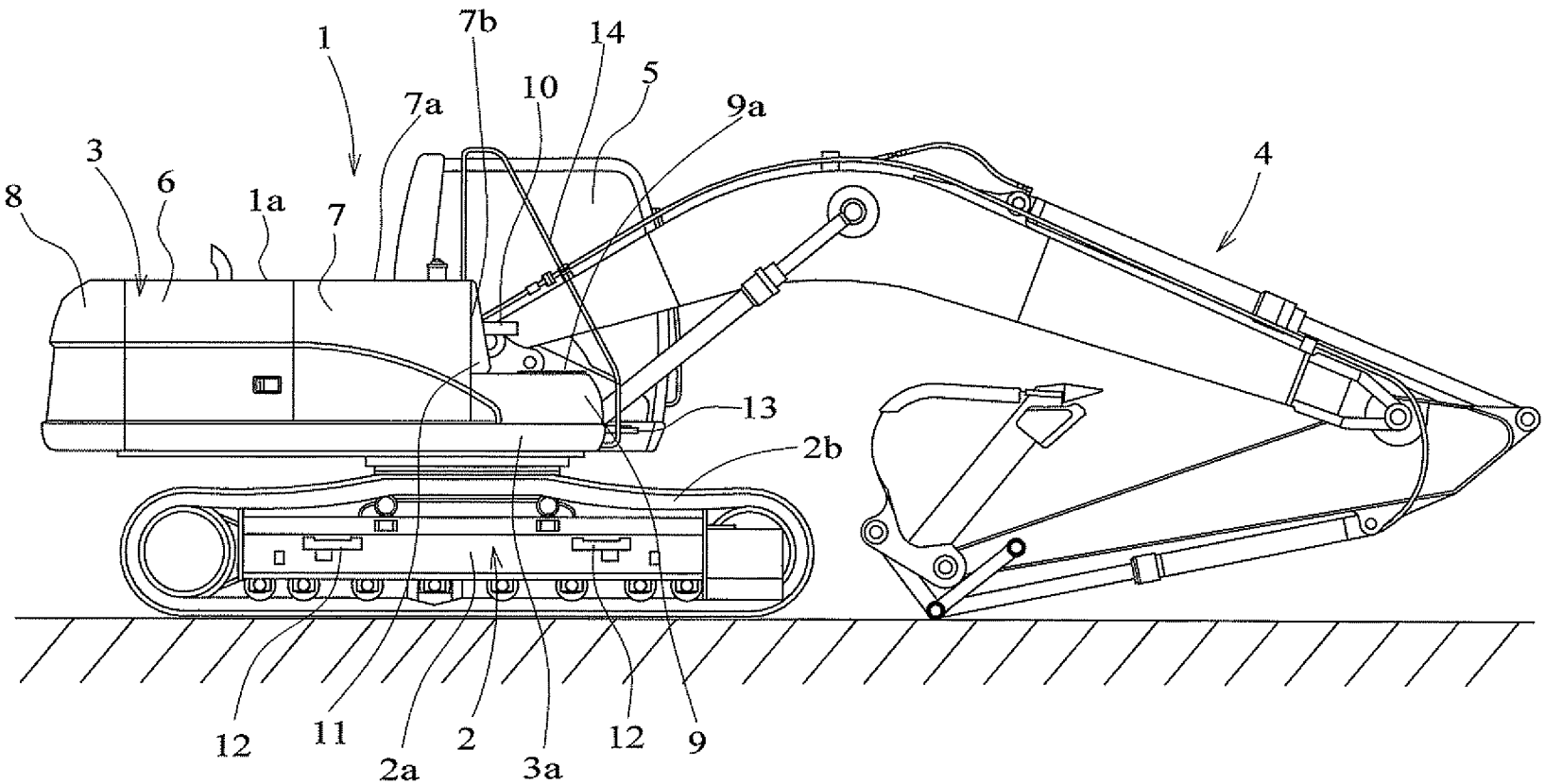
FIG. 1 is a side view of a hydraulic shovel.
Figure 2:
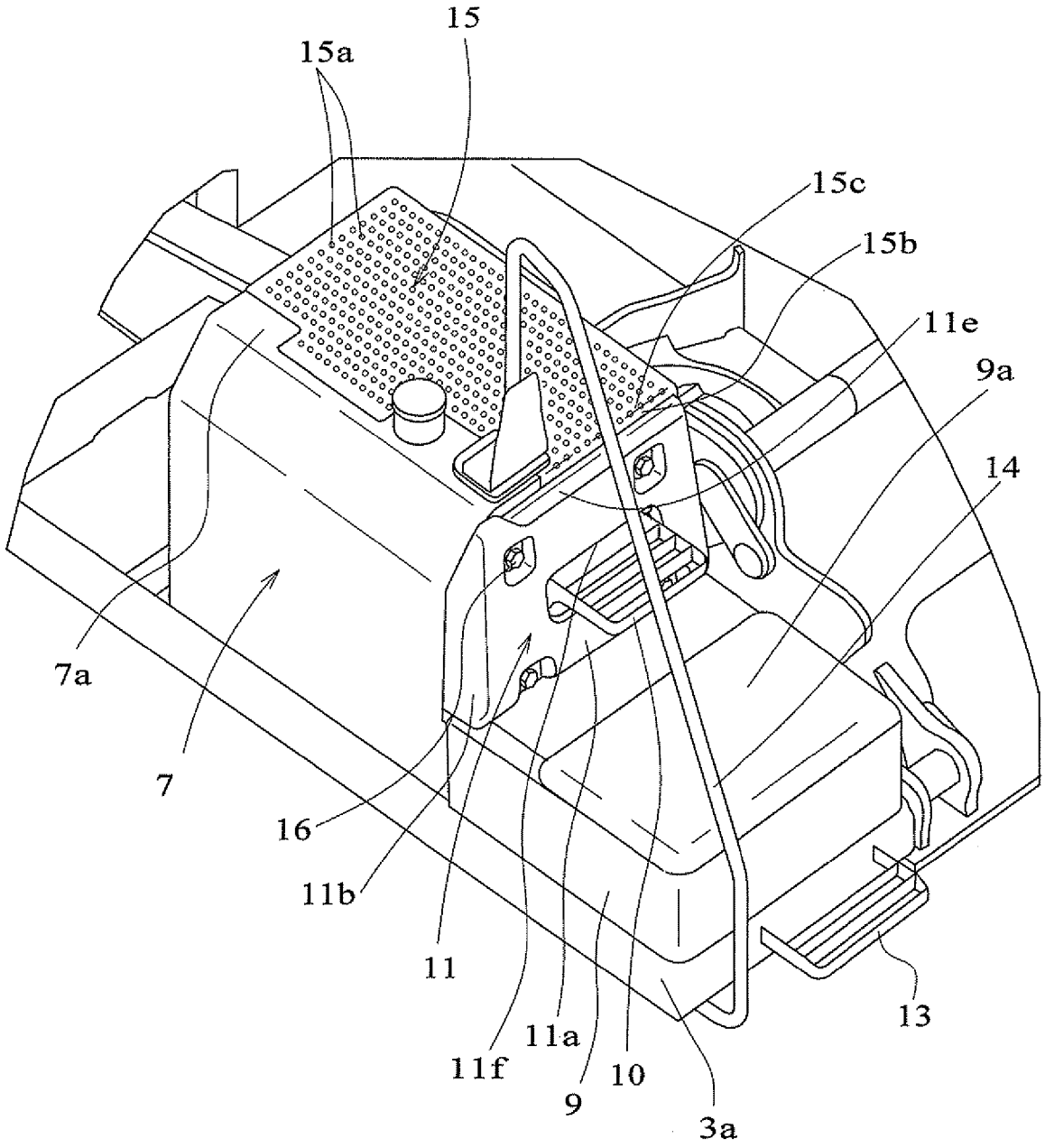
FIG. 2 is a perspective view showing the surrounding of a fuel tank.
Figure 3:
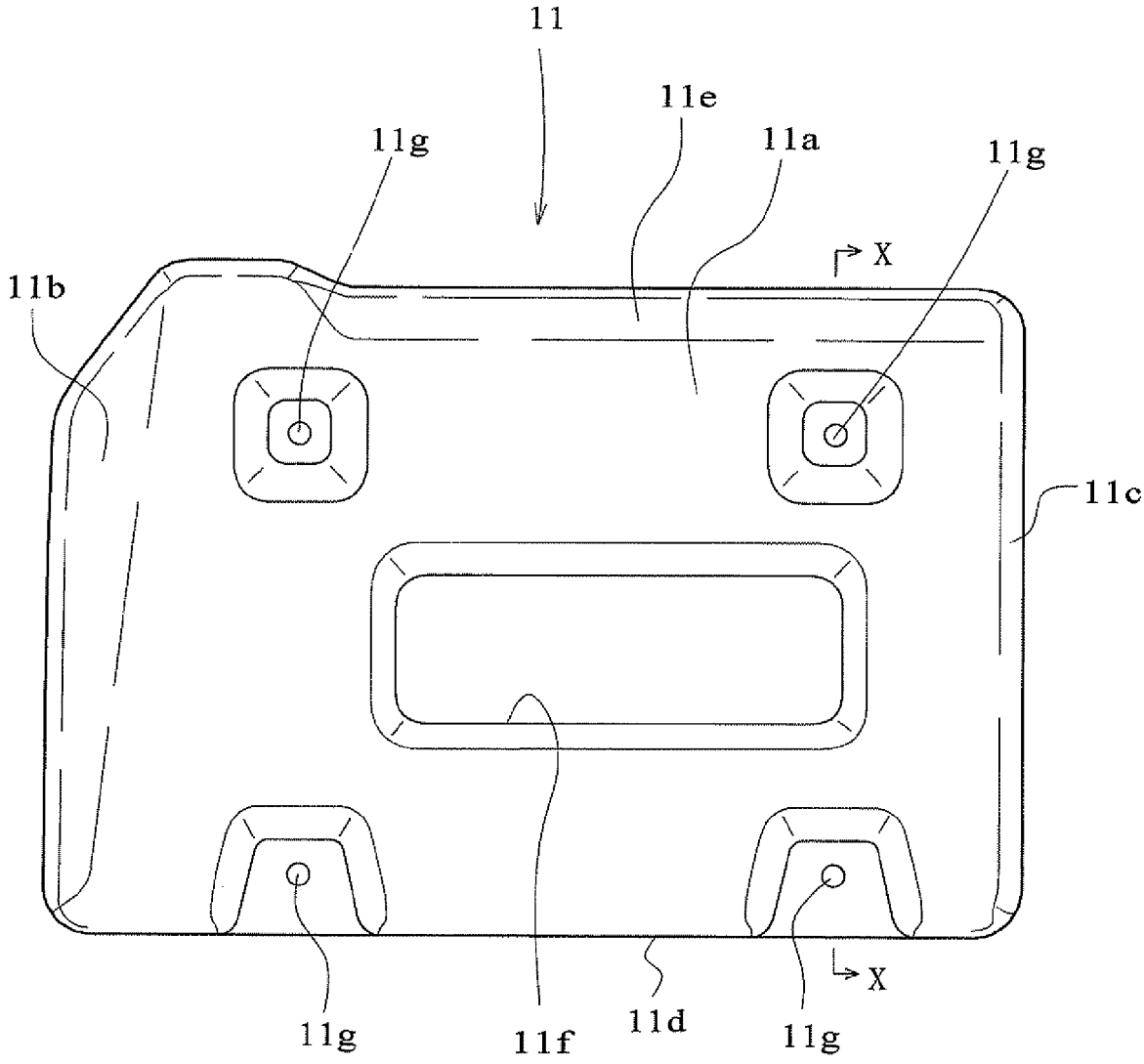
FIG. 3 is a front view of a dressing cover.
Figure 4A:
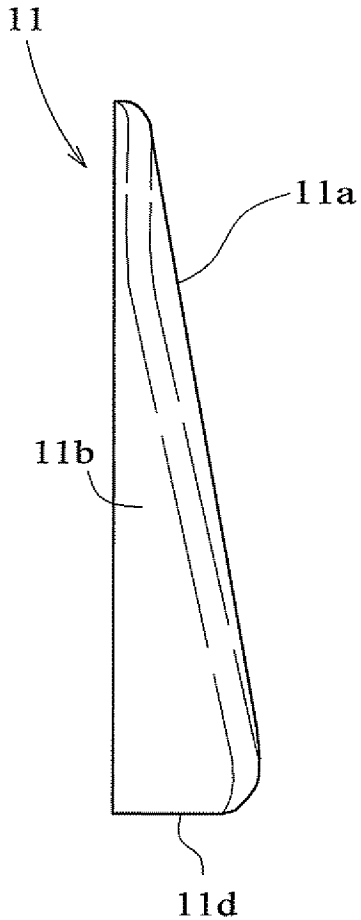
FIG. 4A is a left side view of the dressing cover.
Figure 4B:
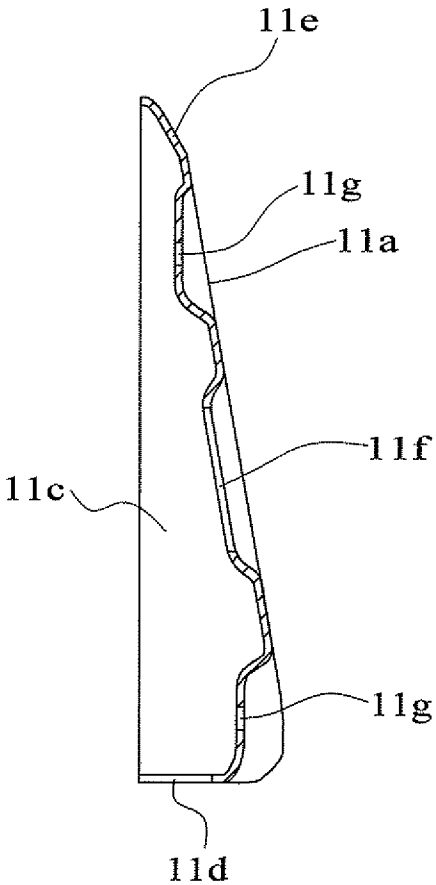
FIG. 4B is a sectional view along X-X of FIG. 3.
Figure 4C:
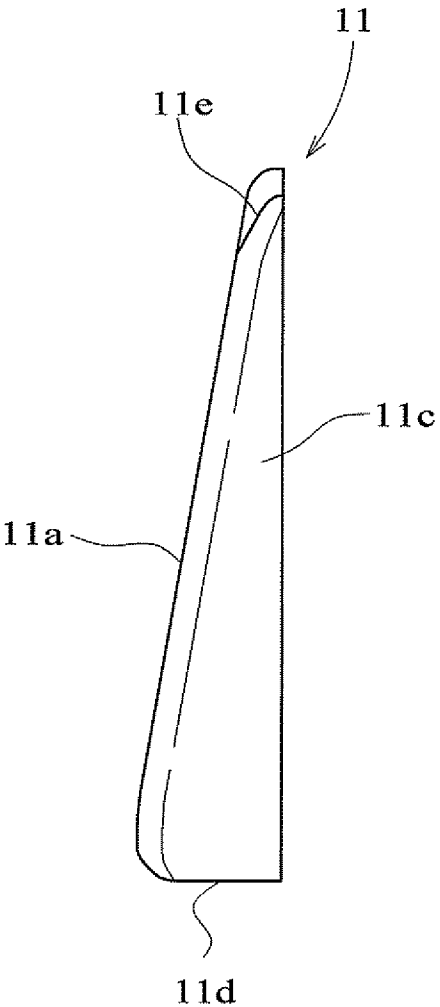
FIG. 4C is a right side view of the dressing cover.
Figure 5:
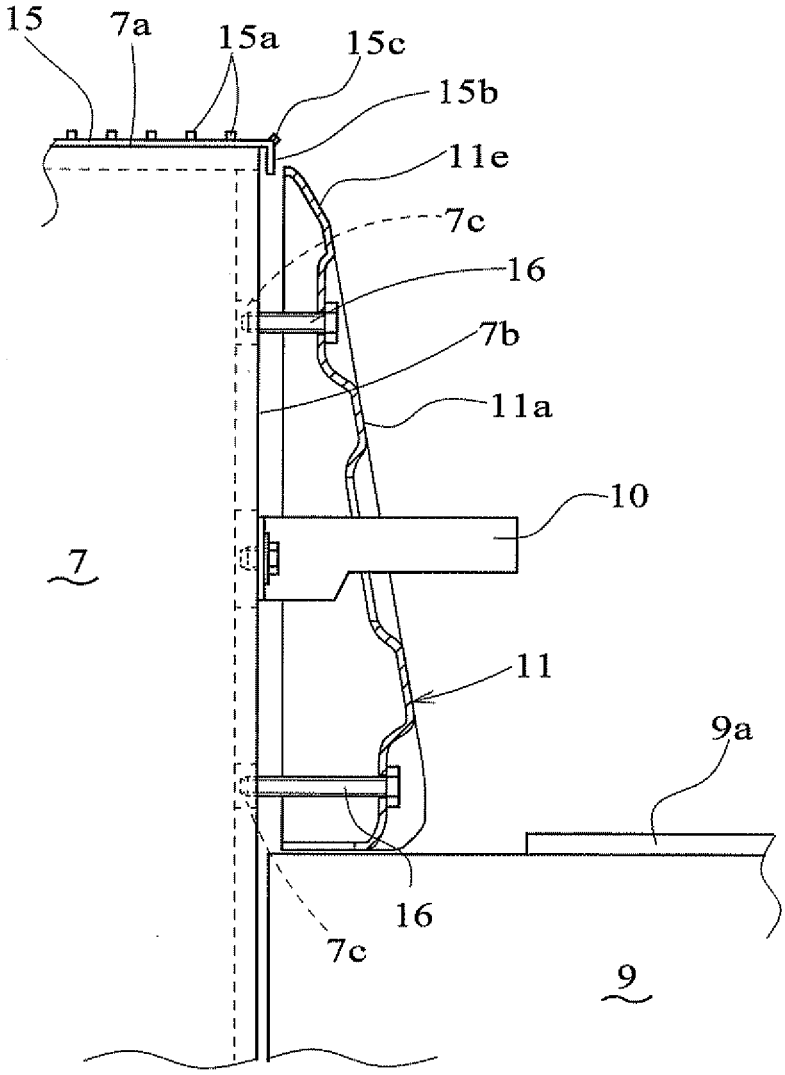
FIG. 5 is a view showing attachment of the dressing cover.

Next, an embodiment of the present disclosure will be described with reference to the drawings. In the drawings, the reference numeral 1 denotes a hydraulic shovel as an example of a construction machine. The hydraulic shovel 1 includes a crawler-type lower traveling body 2 and an upper turning body 3 supported turnably on the lower traveling body 2. The upper turning body 3 includes a front work portion 4 for performing work such as excavation, a cab 5, an engine room 6 in which various devices such as an engine and a pump unit not shown are housed, a fuel tank 7, a counterweight 8, and a storage box 9 for storing pail cans and tools, etc.

The storage box 9 is disposed at the front end portion on the left side (left side as viewed from the front of the upper turning body 3, the same applies to the following description) of the upper turning body 3. The fuel tank (which is an example of the tank of the present disclosure) 7 is disposed on the rear side of the storage box 9, with the upper surface 7*a* of the fuel tank 7 forming a substantially flux machine body upper surface 1*a* in conjunction with the upper surface of the engine room 6 and the upper surface of the counterweight 8. When performing work such as maintenance and refueling of the devices inside the engine room 6, the upper surface 7*a* of the fuel tank 7 is used as a scaffold or walkway by a worker (user).

On the other hand, the upper surface 9*a* of the storage box 9 is configured so as to open and close in order to store objects such as pail cans to be put in and pulled out of the storage box 9. The height of the upper surface 9*a* of the storage box 9 is designed to be lower than the upper surface 7*a* of the fuel tank 7. Further, to the front surface 7*b* of the fuel tank 7, at a substantially intermediate height between the upper surface 7*a* of the fuel tank 7 and the upper surface 9*a* of the storage box 9, a climbing step 10, which a worker puts his/her foot on, is attached. A worker can put his/her foot on the climbing step 10 and go up and down between the upper surface 9*a* of the storage box 9 and the upper surface 7*a* of the fuel tank 7.

As described later, a part of the front surface 7*b* of the fuel tank 7 is covered by a dressing cover 11. The dressing cover 11 includes a step opening 11*f* through which the climbing step 10 penetrates. The climbing step 10 attached to the front surface 7*b* of the fuel tank 7 is provided so as to penetrate through the step opening 11*f* of the dressing cover 11 and project forward of the dressing cover 11.

Further, the reference numeral 12 denotes a step attached to a frame 2*a* of the lower traveling body 2, the reference numeral 13 denotes a step attached to a mount frame 3*a* of the upper turning body 3. A worker can access the upper surface 9*a* of the storage box 9 from the ground by passing over the upper surfaces of the steps 12 and 13 and a crawler 2*b*. The reference numeral 14 is a handrail to be gripped by a worker when the worker goes up and down. One end side of the handrail 14 is supported on the front side left end portion of the mount frame 3*a* of the upper turning body 3, and the other end side is supported on the left side end portion of the upper surface 7*a* of the fuel tank 7.

Here, to the upper surface 7*a* of the fuel tank 7, an upper surface plate 15 having a plurality of antiskid protrusions 15*a* is attached. The front side edge portion (dressing cover side edge portion) of the upper surface plate 15 is bent downward and slightly hung down from the upper surface 7*a* of the fuel tank 7. At the corner portion 15*c* on the upper end of the hung-down portion 15*b*, an antiskid protrusion 15*a* is also formed so as to prevent a worker from slipping even when the worker puts his/her foot on the corner portion 15*c* of the upper surface plate 15.

Surface plates with an antiskid function are also attached to the upper surface of the engine room 6 forming the machine body upper surface 1*a* in conjunction with the upper surface 7*a* of the fuel tank 7 and the upper surface 9*a* of the storage box 9 although these face plates are not shown. Accordingly, a worker is prevented from slipping when the worker gets onto and off the machine body upper surface 1*a* or performs work.

On the other hand, the front surface 7*b* of the fuel tank 7 is a tank side surface on the side where a worker who gets onto and off the upper surface 7*a* of the fuel tank 7 from the upper surface 9*a* of the storage box 9 passes. As described above, to the front surface, the climbing step 10 is attached, and the front surface 7*b* of the fuel tank 7 is covered by a dressing cover 11.

The dressing cover 11 is provided for improving the external appearance by hiding weld marks, etc., on the front surface 7*b* of the fuel tank 7. The dressing cover 11 includes a front surface 11*a*, a left surface 11*b*, a right surface 11*c*, and a lower surface 11*d*, and has a substantially rectangular triangle shape in a side view, and the rear surface side opposed to the front surface 7*b* of the fuel tank 7 is open.

The front surface 11*a* of the dressing cover 11 is inclined so as to become closer to the front surface 7*b* of the fuel tank 7 toward the upper side. The upper portion of the front surface 11*a* is formed by an inclined surface 11*e* with an inclination angle set so as not to allow a worker going up and down between the upper surface 9*a* of the storage box 9 and the upper surface 7*a* of the fuel tank 7 to step onto the upper portion. Specifically, the upper portion of the front surface 11*a* of the dressing cover 11 is formed by a sharp-pointed inclined surface 11*e* which becomes closer to the front surface 7*b* of the fuel tank 7 toward the upper side so that a worker going up and down cannot step onto the upper portion. The inclined surface 11*e* is formed across the entire upper portion of the front surface 11*a* except for portions on which the handrail 14 is disposed and which are unlikely to be stepped on by a worker (the left side end portion of the dressing cover 11 in the present embodiment).

Figure 6:
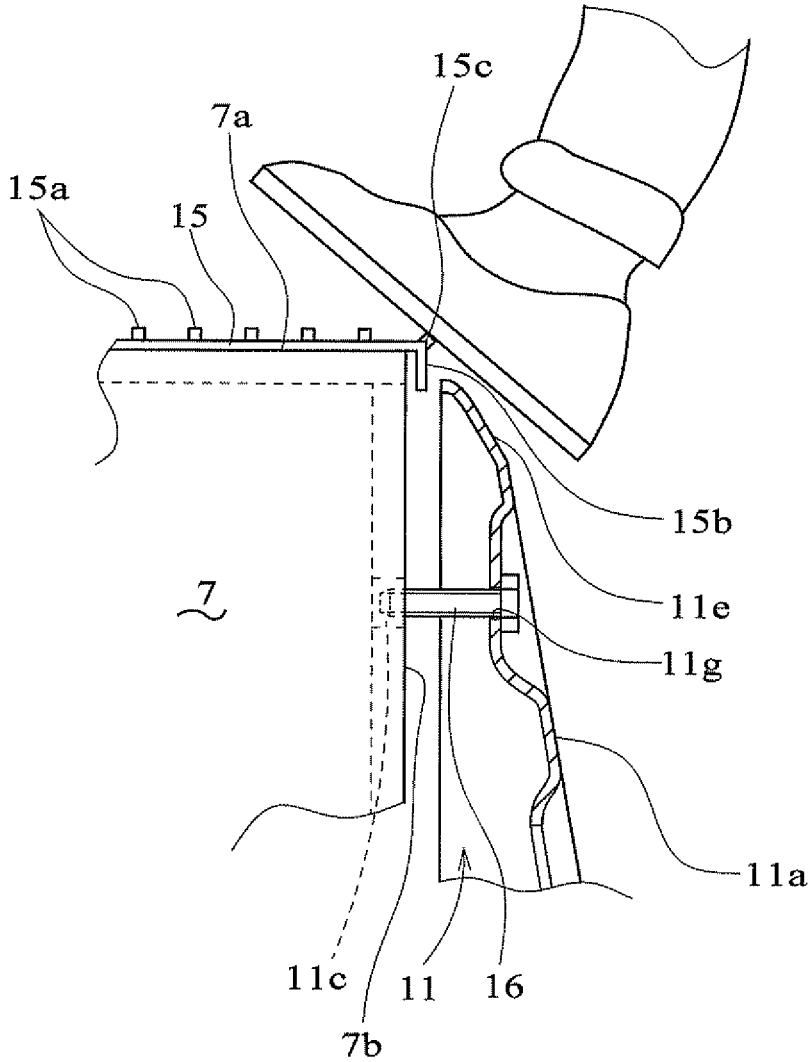
FIG. 6 is an enlarged view of a portion of FIG. 5.

Further, the upper end position of the inclined surface 11*e* is lower than the upper surface 7*a* of the fuel tank 7. Accordingly, even when a worker puts his/her foot on the corner portion 15*c* of the upper surface plate 15, the foot can be reliably prevented from stepping on the upper end of the inclined surface 11*e* (see FIG. 6).

Here, as described above, the front side edge portion of the upper surface plate 15 is bent downward and slightly hung down from the upper surface plate 7*a* of the fuel tank 7, and the lower end of the hung-down portion 15*b* is designed so as to be positioned slightly lower than the upper end position of the inclined surface 11*e*. Accordingly, by the hung-down portion 15*b* of the upper surface plate 15, the fuel tank front surface 7*b* between the upper end of the inclined surface 11*e* and the fuel tank upper surface 7*a* is covered.

In the front surface 11*a* of the dressing cover 11, as described above, the step opening 11*f* through which the climbing step 10 penetrates is open, and through holes 11*g* for bolts 16 for attaching the dressing cover 11 to the front surface 7*b* of the fuel tank 7 are open at four positions in total. By screwing the bolts 16 inserted into the through holes 11*g* from the front side of the dressing cover 11 into screw hole portions 7*c* formed in the front surface 7*b* of the fuel tank 7, the dressing cover 11 can be attached to the front surface 7*b* of the fuel tank 7.

In the present embodiment configured as described above, when a worker performs work such as maintenance or refueling by getting onto the machine body upper surface 1*a*, the worker passes over the upper surface 9*a* of the storage box 9 disposed ahead of the fuel tank 7 and gets onto and off the upper surface 7*a* of the fuel tank 7. The front surface 7*b* of the fuel tank 7 (the tank side surface on the side the worker passes to get onto and off the upper surface 7*a* of the fuel tank 7) is covered by the dressing cover 11. The upper portion of the dressing cover 11 is formed by a sharp-pointed inclined surface 11*e* which becomes closer to the front surface 7*b* of the fuel tank 7 toward the upper side. That is, an inclined surface 11*e* is used with an inclination angle set so as not to allow the worker who gets onto and off the upper surface 7*a* of the fuel tank 7 to step on the upper portion.

As a result, a worker who gets onto and off the upper surface 7*a* of the fuel tank 7 can be reliably prevented from stepping on the upper portion of the dressing cover 11. Therefore, it is not necessary to structure the dressing cover 11 such that the dressing cover 11 withstands having a worker step on it (e.g., strength and attachment). Therefore, the dressing cover 11 can be made light in weight and inexpensive, and does not need to have an antiskid function, thus greatly contributing to cost reduction.

Further, the inclined surface 11*e* is formed across the entire upper portion of the dressing cover 11 except for the portions unlikely to be stepped on by a worker who gets onto and off the upper surface 7*a* of the fuel tank 7 (in the present embodiment, the left side end portion which is provided with a handrail 14 and unlikely to be stepped on by a worker). Therefore, the worker can be prevented from stepping on the dressing cover 11 across the entire upper portion of the dressing cover 11.

Further, the upper end position of the inclined surface 11*e* is lower than the upper surface 7*a* of the fuel tank 7. As a result, the risk of stepping on the upper end of the inclined surface 11*e* by a worker's foot put on the upper surface 7*a* of the fuel tank 7 can be reliably prevented.

To the upper surface 7*a* of the fuel tank 7, the upper surface plate 15 with a plurality of antiskid protrusions 15*a* is attached. The front side edge portion (edge portion on the side provided with the dressing cover 11) of the upper surface plate 15 is bent downward and slightly hung down from the upper surface 7*a* of the fuel tank 7. By the hung-down portion 15*b*, the fuel tank front surface 7*b* between the upper end of the inclined surface 11*a* of the dressing cover 11 and the fuel tank upper surface 7*a* is covered. Accordingly, as described above, although the upper end position of the inclined surface 11*e* is made lower than the upper surface 7*a* of the fuel tank 7, the upper portion of the front surface 7*b* of the fuel tank 7 is not exposed, and excellent external appearance can be obtained.

The present disclosure relates to a dressing cover structure provided for covering a tank side surface in a construction machine, which allows a worker to get onto and off an upper surface of a tank. With the configuration of the present disclosure, a worker who gets onto and off the tank upper surface can be reliably prevented from stepping on the upper portion of the dressing cover. It is thus not necessary to make the structure withstand stepping on by a worker (e.g., strength and attachment), and the dressing cover can be made light in weight and inexpensive. Further, the dressing cover does not need to be provided with an antiskid function, which greatly contributes to cost reduction.

What is claimed is:

1. A construction machine comprising:

a tank with an upper surface and a side surface that is configured to allow a user to get onto and off the upper surface; and a dressing cover that covers part of the side surface, wherein:

the whole dressing cover is placed laterally outside of the whole tank;

an upper portion of the dressing cover has a sharp pointed inclination surface that becomes closer to the side surface of the tank toward an upper side; and an upper end of the sharp pointed inclination surface of the dressing cover is lower than the upper surface of the tank.

2. The construction machine according to claim 1, wherein:

the upper portion of the dressing cover has a first part and a second part, a handrail supported by the upper surface of the tank is located adjacent to the second part of the upper portion, and the sharp pointed inclination surface of the dressing cover is formed across the first part of the upper portion.

3. The construction machine according to claim 1 wherein:

an upper surface plate with an antiskid portion is attached to the upper surface of the tank, a dressing cover side edge portion of the upper surface plate is bent downward and hung down from the upper surface of the tank, and the side surface of the tank between the upper end of the sharp pointed inclination surface of the dressing cover and the upper surface of the tank is covered by the dressing cover side edge portion.

4. The construction machine according to claim 3, wherein a lower end of the dressing cover side edge portion is lower than the upper end of the sharp pointed inclination surface of the dressing cover.

5. The construction machine according to claim 3, wherein the antiskid portion is a plurality of protrusions located at a top surface of the upper surface plate and at a corner portion between the top surface and the dressing cover side edge portion.

6. The construction machine according to claim 1, wherein:

a step is attached to the side surface of the tank at a substantially intermediate height between the upper surface of the tank and a surface below the dressing cover, and the dressing cover includes an opening through which the step penetrates.

7. The construction machine according to claim 2, wherein:

an upper surface plate with an antiskid portion is attached to the upper surface of the tank, a dressing cover side edge portion of the upper surface plate is bent downward and hung down from the upper surface of the tank, and the side surface of the tank between the upper end of the sharp pointed inclination surface of the dressing cover and the upper surface of the tank is covered by the dressing cover side edge portion.

8. The construction machine according to claim 7, wherein a lower end of the dressing cover side edge portion is lower than the upper end of the sharp pointed inclination surface of the dressing cover.

9. The construction machine according to claim 7, wherein the antiskid portion is a plurality of protrusions located at a top surface of the upper surface plate and at a corner portion between the top surface and the dressing cover side edge portion.

* * * * *

UNITED STATES PATENT AND TRADEMARK OFFICE

CERTIFICATE OF CORRECTION

PATENT NO. : 8,454,043 B2
APPLICATION NO. : 12/867157
DATED : June 4, 2013
INVENTOR(S) : Uto et al.

It is certified that error appears in the above-identified patent and that said Letters Patent is hereby corrected as shown below:

In the Claims

Column 6, line 10, in Claim 3, delete “claim 1” and insert -- claim 1, --.

Signed and Sealed this
Eleventh Day of August, 2015

Michelle K. Lee

Michelle K. Lee
*Director of the United States Patent and Trademark Office*